US010450903B2

(12) United States Patent
Jeon et al.

(10) Patent No.: US 10,450,903 B2
(45) Date of Patent: Oct. 22, 2019

(54) VARIABLE VALVE LIFT ACTUATOR OF ENGINE

(71) Applicant: MOTONIC CORPORATION, Seoul (KR)

(72) Inventors: Wan Jae Jeon, Daegu (KR); Soo Hyun Hwang, Daegu (KR); Jong Wung Park, Daegu (KR); Jun Min Park, Daegu (KR); Chan Wung Park, Daegu (KR); Dong Hyeong Lee, Daegu (KR)

(73) Assignee: MOTONIC CORPORATION, Seoul (KR)

( * ) Notice: Subject to any disclaimer, the term of this patent is extended or adjusted under 35 U.S.C. 154(b) by 137 days.

(21) Appl. No.: 15/713,028

(22) Filed: Sep. 22, 2017

(65) Prior Publication Data

US 2019/0048761 A1 Feb. 14, 2019

(30) Foreign Application Priority Data

Aug. 10, 2017 (KR) ..... 10-2017-0101442

(51) Int. Cl.

| | |
|---|---|
| ***F01L 1/34*** | (2006.01) |
| ***F01L 1/22*** | (2006.01) |
| ***F01L 1/18*** | (2006.01) |
| ***F01L 1/26*** | (2006.01) |
| ***F01L 13/00*** | (2006.01) |
| ***F01L 9/04*** | (2006.01) |
| ***F02D 13/06*** | (2006.01) |

(52) U.S. Cl.

CPC ..... *F01L 1/22* (2013.01); *F01L 1/18* (2013.01); *F01L 1/181* (2013.01); *F01L 1/267* (2013.01); *F01L 9/04* (2013.01); *F01L 13/0005* (2013.01); *F01L 13/0036* (2013.01); *F02D 13/06* (2013.01); *F01L 2001/186* (2013.01); *F01L 2013/001* (2013.01); *F01L 2105/00* (2013.01)

(58) Field of Classification Search

CPC ..... F01L 1/22; F01L 1/18; F01L 1/181; F01L 1/267; F01L 9/04; F01L 13/0005; F01L 13/0036; F01L 2001/186; F01L 2013/001; F01L 2105/00; F02D 13/06

See application file for complete search history.

(56) References Cited

U.S. PATENT DOCUMENTS 6,318,318 B1 * 11/2001 Jahr ..... F01L 1/185 123/90.16
2015/0369095 A1 * 12/2015 Spoor ..... F01L 1/185 123/90.45

FOREIGN PATENT DOCUMENTS

KR 10-1675511 B1 11/2016
KR 1020170005567 A 1/2017

(Continued)

*Primary Examiner* — Zelalem Eshete
(74) *Attorney, Agent, or Firm* — Novick, Kim & Lee, PLLC; Jae Youn Kim

(57) ABSTRACT

Provided is a variable valve lift actuator of an engine, which includes: a first body rotating; a second body; a driving module; and a return spring, wherein an entire portion or a partial front end of the driving module is inserted into a rear end of the second body, the lift degree of the valve is variably controlled in two stages of a high-speed mode and a low-speed mode based on an operating condition of the engine, and when only the high-speed cam is installed on the camshaft, the driving pin is operated in a low-speed and low-load state of the engine to separate the first body from the second body so as to deactivate a cylinder.

6 Claims, 10 Drawing Sheets

(56) References Cited

FOREIGN PATENT DOCUMENTS

| | | |
|---|---|---|
| KR | 10-1716321 B1 | 3/2017 |
| KR | 10-1736806 B1 | 5/2017 |

* cited by examiner

VARIABLE VALVE LIFT ACTUATOR OF ENGINE

BACKGROUND OF THE INVENTION

1. Field of the Invention

The present invention relates to a variable valve lift actuator of an engine, and more particularly, to a variable valve lift actuator of an engine for controlling a lifting degree of the valve according to a driving condition of a vehicle.

2. Description of the Related Art

A valve mechanism applied to a vehicular engine supplies mixed air to a combustion chamber and discharges combustion gas according to strokes of the engine.

Recently, variable valve mechanisms have been developed and applied to engines for optimizing an inflow rate of the mixed gas and the exhaust efficiency of the combustion gas by varying an opening degree and an opening/closing timing of the valve based on an operating condition of the engine, in other words, based on an operating area of the engine defined by the rotational speed and the load of the engine.

Accordingly, variable valve mechanisms for the vehicular engines can improve engine performance such as fuel efficiency, torque, and power output of the engine and reduce the amount of exhaust gas.

The above variable valve mechanism for the vehicular engine includes a variable valve timing mechanism for varying the opening/closing timing of the valve, a variable valve lift mechanism for varying the opening amount of the valve, and a variable valve operational angle mechanism for varying the operational angle of the valve.

Among them, the variable valve lift mechanism is directed to improve the power output and the fuel efficiency in a low and medium speed mode, and is classified into a rocker arm type, a pivot type, a tappet type, and a bucket type.

Meanwhile, since the conventional variable valve lift mechanism has a constant displacement of an intake valve regardless of the load of the vehicle, the engine speed for implementing optimum efficiency is limited and a combustion is unstable due to a back-flow of the exhaust gas in the case of a state of low-speed and low load, thus the fuel efficiency of the vehicle is lowered.

Accordingly, hydraulic pressure is used to pause the valve, which causes a complicated structure of the variable valve lift mechanism, thus the workability is deteriorated.

In addition, in the case of using the hydraulic pressure, the viscosity of hydraulic fluid is sensitively reacted with respect to the temperature, thereby changing the working hydraulic pressure, thus a malfunction of the variable valve lift mechanism occurs and the accuracy is deteriorated upon adjusting the valve lift degree.

To solve the above problem, an applicant of the present invention has denoted and has been registered now with various documents such as following patent documents 1 to 3 which disclose an engine variable valve lift technology which improves the engine efficiency by performing a pause control operation and a two-stage variable control operation of a high-speed mode and a low-speed mode to deactivate some cylinders under the condition of the low-speed and low-load of the engine and activate the entire cylinder under the condition of high-speed and high-load.

SUMMARY OF THE INVENTION

Meanwhile, according to patent documents 1 to 3, a latching pin for connecting or disconnecting first and second bodies is applied, and a driving module is installed at a rear side of the latching pin, so that a latching module is operated to protrude and retract.

Accordingly, patent documents 1 to 3 have a limit to completely solve a structural limitation of the cylinder head since a separate space is required for installing the driving module, which is installed at the rear side of the first and second bodies, in a cylinder head.

In addition, according to patent documents 1 to 3, the number of parts are increased due to the application of the latching pin and a latching spring, and the operating performance is deteriorated in the process of transferring driving force of the driving module to the latching pin to protrude and retract.

To solve the problems as mentioned above, an object of the present invention is to provide a variable valve lift actuator of an engine for controlling the lift degree of the valve according to the driving condition of the vehicle.

Another object of the present invention is to provide a variable valve lift actuator of an engine for deactivating some cylinders in a condition of low-speed and low load of the vehicle.

Still another object of the present invention is to provide a variable valve lift actuator of an engine for solving the structural limitation of the cylinder head upon installation in the vehicle, and reducing the number of parts so as to reduce manufacturing costs, and improve the operating performance.

To achieve the above-mentioned object, the variable valve lift actuator of the engine according to the present invention includes a first body rotating in a predetermined angular range according to a rotational motion of a high-speed cam coupled to a camshaft, a second body connected to or disconnected from the first body, rotated according to the rotational motion of the high-speed cam when connected with the first body, and rotated according to a rotational motion of low-speed cams provided on both sides of the high-speed cam when disconnected with the first body, so that a lift degree of the valve is adjusted, a driving module for operating a driving pin to protrude toward or retract from a front of the first body so as to connect or disconnect the first body with the second body, a rotary shaft disposed on an upper portion of the valve, and installed while crossing both side walls of the first and second bodies to enable the first body to rotate, and a return spring installed on the rotary shaft for providing restoring force to return the first body rotated according to the high-speed cam to an original position, and wherein the lift degree of the valve is variably controlled in two stages of a high-speed mode and a low-speed mode based on an operating condition of the engine, when only the high-speed cam is installed on the camshaft, a pause control operation is performed in which the driving pin is operated in a low-speed and low-load state of the engine to separate the first body from the second body so as to deactivate a cylinder, and an entire portion or a partial front end of the driving module is inserted into a rear end of the second body.

As above-mentioned, according to the variable valve lift actuator of the engine of the present invention, the pause control operation of the valve for deactivating some cylinders and the two-stage variable control operation of the high-speed mode and the low-speed mode can be performed based on the operating condition of the engine.

In other words, according to the present invention, the opening/closing operation and the pause control operation of the valve are implemented by selectively connecting or disconnecting the first body with the second body by using the driving pin of the driving module, so that some cylinders can be deactivated in the low-speed and low-load condition of the engine.

Accordingly, according to the present invention, the fuel consumption amount is minimized in the low-speed and low-load state of the engine, so that the efficiency of the engine can be improved and the fuel efficiency of the vehicle can be maximized.

In addition, according to the present invention, the conventional latching pin and latching spring are removed, and the first and second bodies are connected or disconnected with each other by using the driving pin of the driving module, so that dynamic characteristics and operating performance of the valve can be improved, and the number of parts can be reduced, thereby reducing manufacturing costs.

In addition, according to the present invention, the driving module is installed while being inserted into the rear end of the second body so as to minimize a mounting space when mounted on the cylinder head, so that the structural constraint of the cylinder head can be minimized.

In addition, according to the present invention, the return spring for returning the first body to the original position is installed inside the first body, a head machining work of the first body can be removed in which the head machining work is required when a compression spring is installed to make contact with a lower portion of the first body in the related art.

Accordingly, according to the present invention, the head machining work of the first body caused by the application of the conventional compression spring is removed, so that workability can be improved, and the variable valve lift actuator of the engine can be simply configured, thus the present invention can be easily applied to an actual vehicular engine.

In addition, according to the present invention, a pivot point which is a rotational center of the first body is moved toward the valve to reduce weight and inertia moment, so that the dynamic characteristics and the operability of the valve can be improved.

In addition, according to the present invention, semi-cylindrical pressing pieces are formed on both sides of the second body, or openings are formed at both sides of the second body and contact surfaces are formed at both ends of a first rotary shaft, thus the pressing pieces or the contact surfaces make contact with upper ends of the valve to increase a contact area, so that the operating characteristics of the valve can be improved.

In addition, according to the present invention, a length of the rotary shaft coupled to the first and second bodies is minimized, so that the weight of a product can be reduced, and the operating characteristics of the valve can be improved.

In addition, according to the present invention, the two-stage control operation and the pause control operation of the valve can be implemented according to the configuration of the cam by using the same variable valve lift actuator.

In addition, according to the present invention, a roller rocker arm and the second body are integrally manufactured in a swing arm type structure instead of the conventional direct operating type, so that costs can be reduced, the rigidity can be reinforced by changing a shape of the front wall of the second body, and the latching property can be easily implemented.

As a result, according to the present invention, the deterioration of the workability and the limitation of the oil temperature (viscosity) due to the process with oil can be solved in the cylinder pause mechanism and the two-stage variable valve lift mechanism using the hydraulic pressure.

DETAILED DESCRIPTION OF THE INVENTION

Hereinafter, a variable valve lift actuator of an engine according to a preferred embodiment of the present invention will be described in detail with reference to the accompanying drawings.

The variable valve lift actuator of the engine according to the present invention is configured to perform a pause control operation for activating or deactivating a cylinder and a two-stage variable control operation for controlling a lift degree of the valve in two stages of a high-speed and a low-speed based on a driving condition of a vehicle.

The specification of the present invention describes a first embodiment for implementing the pause control operation of the valve, and describes a second embodiment for performing a two-stage variable control of the valve based on the configuration of the first embodiment.

To this end, it should be noted that one cam may be installed at a camshaft of the engine in the case of embodying the pause control operation of the valve, and a high-speed cam and low-speed cams on both sides of the high-speed cam may be installed in the case of embodying the two-stage variable control operation of the valve.

Embodiment 1

Figure 1:
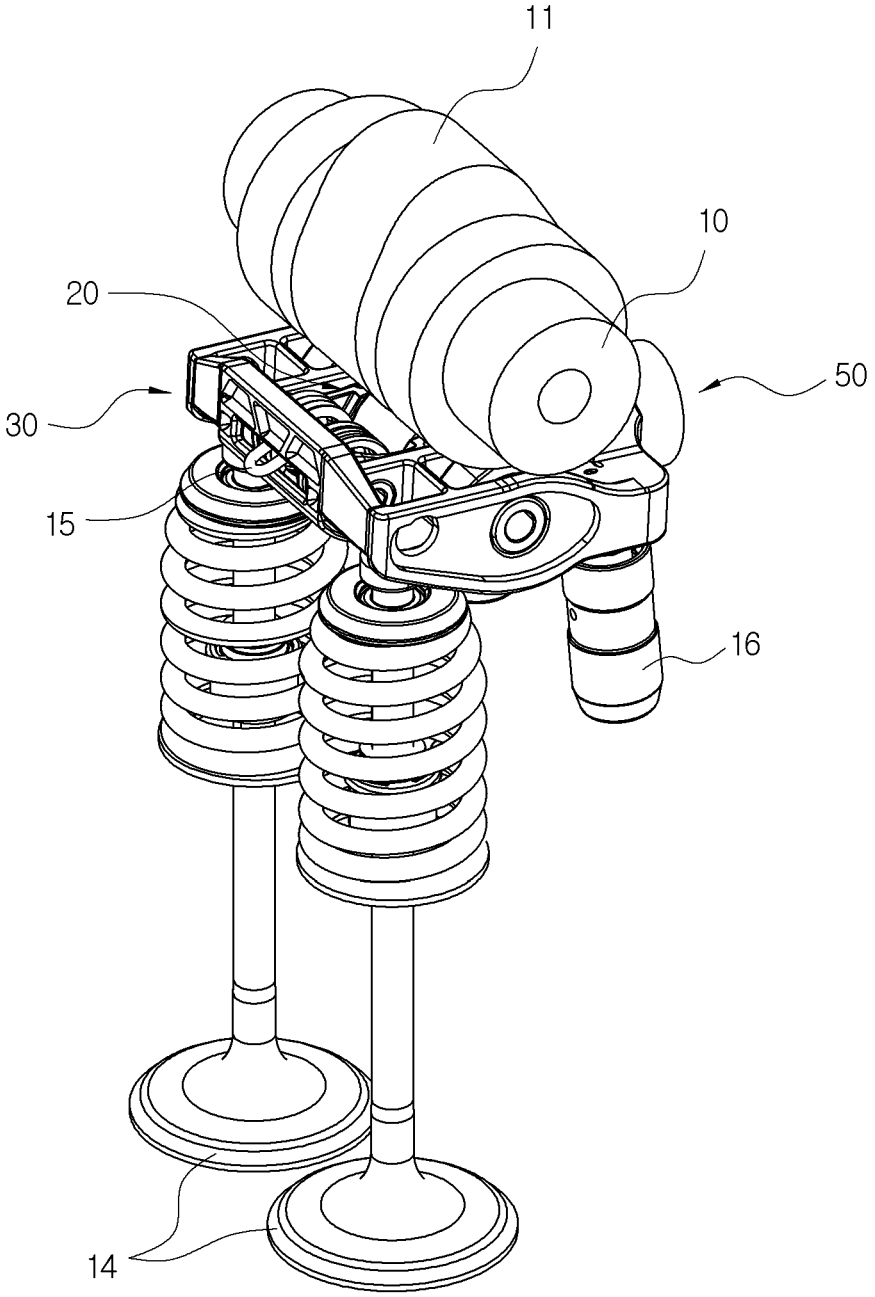
FIG. 1 is a perspective view of a variable valve lift actuator of an engine according to a preferred embodiment of the present invention.
Figure 2:
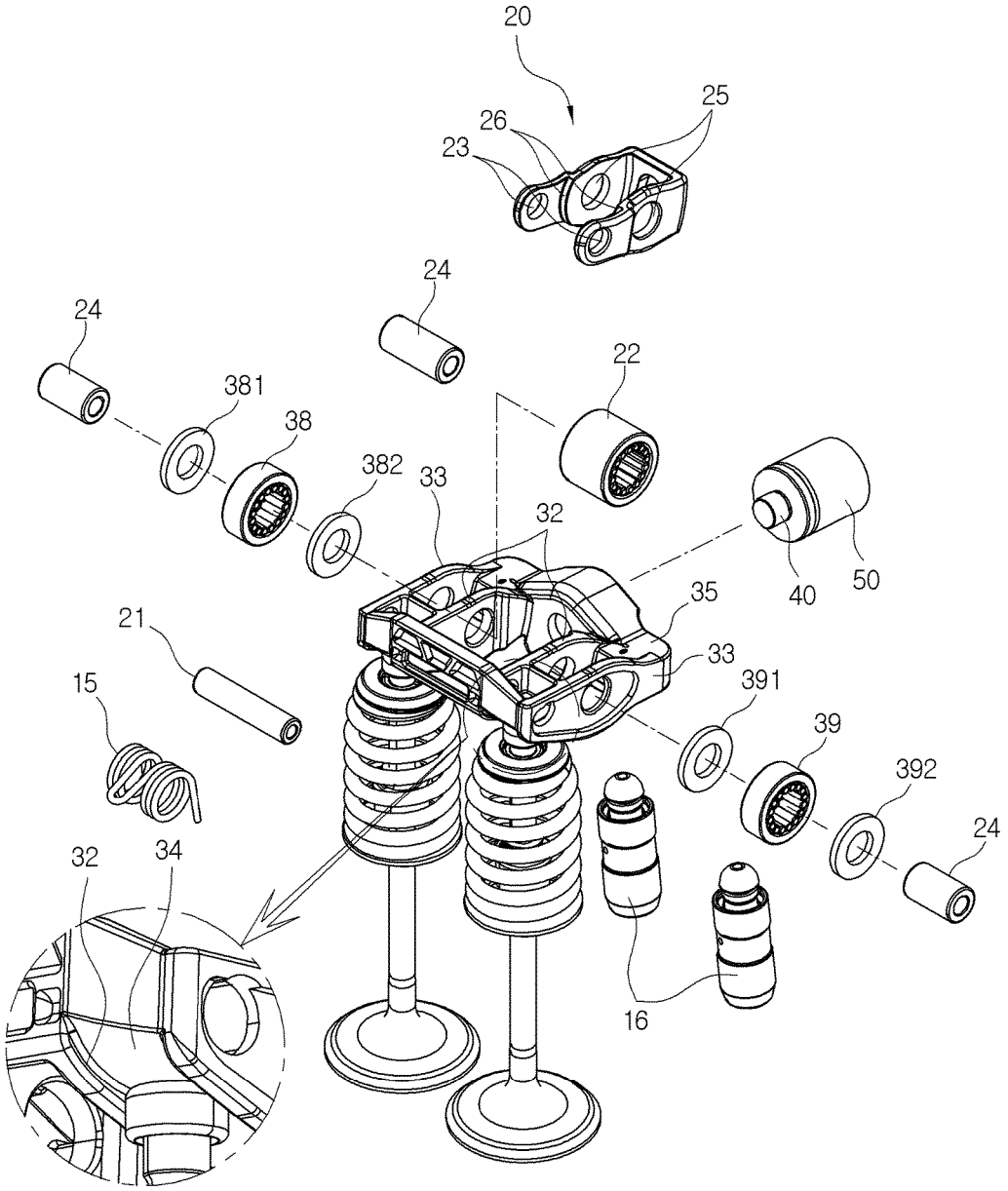
FIG. 2 is a partially exploded perspective view of the variable valve lift actuator shown in FIG. 1.

FIG. 1 is a perspective view of a variable valve lift actuator of an engine according to a preferred embodiment of the present invention. FIG. 2 is a partially exploded perspective view of the variable valve lift actuator shown in FIG. 1.

Figure 3:
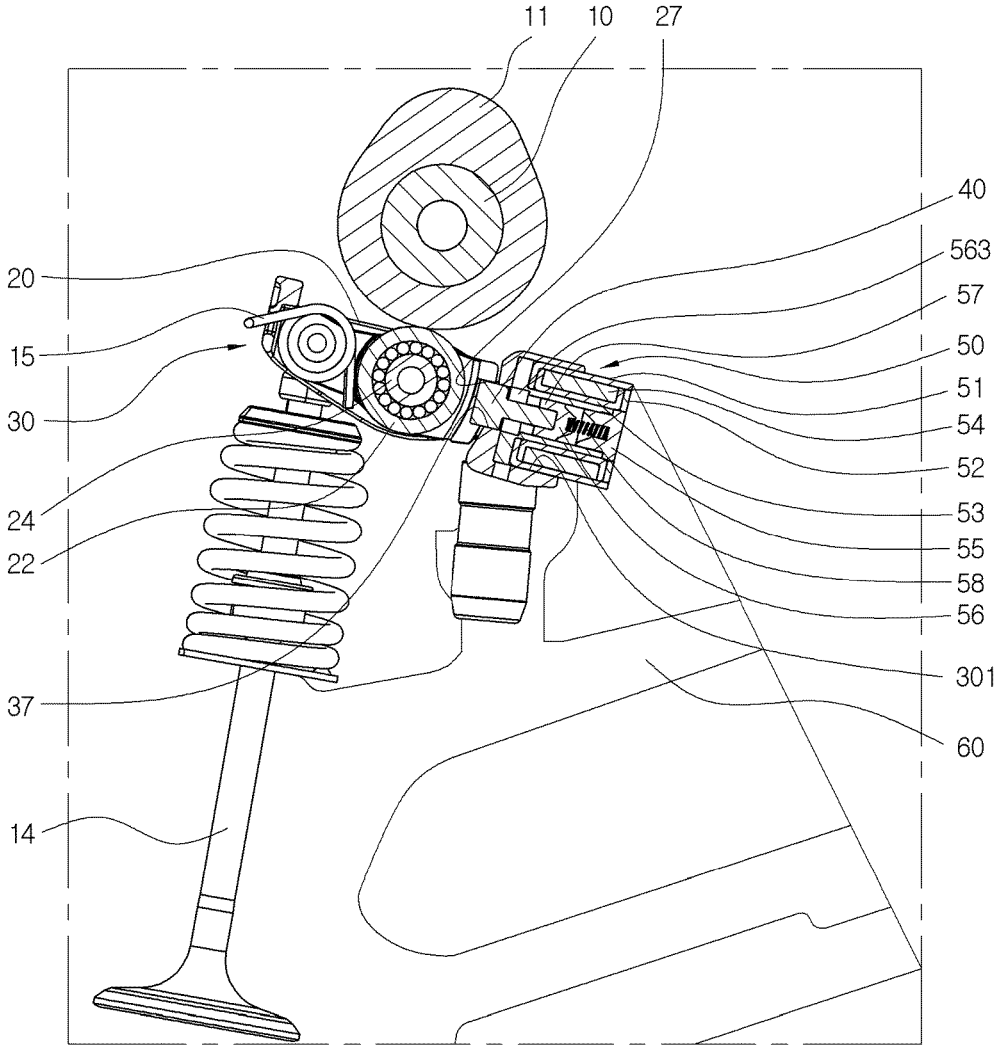
FIG. 3 is an enlarged sectional view describing a state of installing the variable valve lifting actuator shown in FIG. 1 in a cylinder head.

In addition, FIG. 3 is an enlarged sectional view showing a state of installing the variable valve lifting actuator shown in FIG. 1 in a cylinder head.

Hereinafter, the terms indicating a direction such as "left", "right", "front", "rear", "upper" and "lower" are defined to indicate directions on the basis of a state shown in drawings, respectively.

As shown in FIGS. 1 and 2, the variable valve lift actuator of the engine according to a preferred embodiment of the present invention includes a first body 20 rotating in a predetermined angular range by a rotational motion of a cam 11 coupled to a camshaft 10, a second body 30 for opening/closing a valve 14 or maintaining the valve 14 in a closed state based on a connection state of the first body 20, and a driving module 50 for operating a driving pin 40 to protrude toward or retract from a front of the first body 20 so as to connect or disconnect the first body 20 with the second body 30.

As shown in FIG. 3, the number of the variable valve lift actuator of the engine may be prepared to correspond to that of cylinders of the engine, and slantingly installed at an upper portion of a cylinder head 60 by a predetermined preset angle.

In addition, the variable valve lift actuator of the engine according to a first embodiment of the present invention may further include a return spring 15 installed around a rotary shaft 21 on which the first body 20 is rotated, for providing restoring force to return the first body 20 rotated according to the cam 11 to an original position.

The return spring 15 may be prepared as a torsion spring having a center portion protruding forwardly.

For example, the center portion of the return spring 15 may be inserted into an insertion hole 311 formed in a front wall 31 of the second body 30 described below, and protrudes forwardly to be supported so that the return spring is prevented from moving up and down, and both ends of the return spring 15 may be supported by supporting sills 26 formed on both side walls of the first body 20 described below.

According to the present invention, the return spring for returning the first body to the original position is installed on the rotary shaft of the first body, such that a head machining work of the first body can be removed in which the head machining work is required when a compression spring is installed to make contact with a lower portion of the first body in the related art.

According to the present invention, the head machining work of the first body caused by the application of the conventional compression spring is removed, so that workability can be improved, and the variable valve lift actuator of the engine can be simply configured, thus the present invention can be easily applied to an actual vehicular engine.

A front of the first body 20 is opened when viewed from the top, to have a cross section in a substantially U shape, so that both side walls and a rear wall may be provided.

In addition, a roller 22 rotated according to the rotation of the cam 11 may be installed inside the first body 20 so as to minimize friction upon contact with the cam 11.

Coupling holes 23 to which the rotary shafts 21 are coupled may be formed at the front ends of both side walls of the first body 20, respectively, and installation holes 25 in which the roller shaft 24 of the roller 22 is installed may be formed at center portions of the both side walls of the first body 20.

The rotary shaft 21 may pass through and be coupled to the both side walls of the first body 20 and both side walls of the second body 30, and the return spring 15 may be installed around an outer peripheral surface of the center portion of the rotary shaft 21.

Accordingly, the first body 20 may rotate about the rotary shaft 21.

The roller shaft 24 may pass through and be coupled to a pair of installation holes 25 formed in both side walls of the first body 20, and bearings may be provided between the roller shaft 24 and the roller 22 to enable the roller 22 to smoothly rotate.

The above roller shaft 24 may extend to a length corresponding to a distance between a pair of outer side walls 33 of the second body 30 described below, or may be divided in plural as shown in FIG. 2.

Meanwhile, supporting sills 26 may be formed on inner surfaces of both side walls of the first body 20 so as to support both ends of the return spring 15, respectively.

In addition, a latching sill 27 to which the driving pin 40 is latched may be formed on a rear wall of the first body 20, such that the first and second bodies 20 and 30 are integrally rotated according to the rotation of the cam 11 when the driving pin 40 forwardly moves.

A rear side of the second body 30 is opened when viewed from the top to be disposed on the front side and both sides of the first body 20, and the second body 30 may have a front wall 31 and both side walls to be formed in a substantially U shape.

The both side walls of the second body 30 may include an inner side wall 32 and an outer side wall 33, respectively.

Pressing pieces 34 for pressing may be provided on both sides of the front wall 31 of the second body 30 so as to move the valve 14 up and down by making contact with upper ends of the valve 14 between the inner side wall 32 and the outer side wall 33, respectively.

During the rotational motion of the second body 30 according to the rotation of the cam 11, the pressing piece 34 may be formed in a semi-cylindrical shape having a cross section which is downwardly convex so as to smoothly press the upper end of the valve 14.

Accordingly, the pressing piece 34 may downwardly press the upper end of the valve 14 according to the rotational motion of the second body 30 to move the valve up and down, thereby enabling the valve 14 to be opened and closed.

Therefore, according to the present invention, the semi-cylindrical pressing pieces are formed on both sides of the second body so that the pressing piece makes contact with the upper end of the valve so as to increase the contact area, so that the operating characteristics of the valve may be improved.

The rear end of the second body 30 may be supported by a pivot support mechanism 16.

In the embodiment, the pivot support mechanism 16 may be prepared as a hydraulic lash adjuster which automatically adjusts a gap of the valve 14 using hydraulic pressure.

For example, the hydraulic lash adjuster is elastically operated according to pressure changes of oil in a state that the oil is constantly supplied to the inside thereof, thereby finely adjusting the gap of the valve 14.

In other words, the hydraulic lash adjuster maintains a contraction state since an internal check valve maintains a closed state when the oil pressure is lower than a predetermined set pressure.

Whereas, the hydraulic lash adjuster extends since the internal check valve is opened when the oil pressure is equal to or higher than the predetermined set pressure, so a moving path of the oil is opened, thus the rear end of the second body 30 is moved upward, thereby adjusting the gap of the valve 14.

To this end, the second body 30 may be formed at outer sides of the pair of inner side walls 32 thereof with a support plate supported by making contact with an upper end of the pivot support mechanism 16.

Accordingly, the second body 30 may be rotated about the pivot support mechanism 16.

Meanwhile, the second body 30 is provided at the rear end thereof with an installation part through which the driving pin 40 forwardly and slidably passes, and a moving space 37 may be formed at the center portion of the installation part 36 along the back and forth directions.

The above installation part 36 may be provided between the rear end portions of the pair of inner side walls 32 of the second body 30.

In addition, rotating first and second rollers 38 and 39 may be installed on both sides of the second body 30 while making contact with a low-speed cam 13, which is described with reference to the configuration of a second embodiment shown in FIG. 7 as below, in a low-speed and low-load state of the engine.

To this end, the outer side walls 33 on both sides of the second body 30 each extend to a length corresponding to that of the inner side wall 32, and openings 34 and support plates 35 may be formed between the outer side wall 33 and the inner side wall.

Accordingly, the first and second rollers 38 and 39 may be rotatably installed around the roller shaft 24 which passes through and is coupled to the both inner side wall 32 and the outer side wall 33 of the second body 30.

In addition, bearings are installed at the center portions of the first and second rollers 38 and 39, and two pairs of roller bushes 381, 382, 391 and 392 formed in a disc ring shape may be provided on both sides of the first and second rollers 38 and 39 to prevent the bearings from being separated during the rotational motion of the first and second rollers 38 and 39, respectively.

The driving pin 40 may move back and forth according to a magnetic field generated in the driving module 50.

Herein, the driving pin 40 may include a body part 41 formed in a substantially cylindrical shape having a circular or oval cross section and latched to a latching sill 27 of the first body 20 when moved forward, and a coupling part 42 having a diameter smaller than a diameter of the body part 41 and coupled to a plunger installed in an inner space of the sleeve 56 of the driving module 50 described as below.

The driving module 50 serves to move the driving pin 40 back and forth according to a control signal of an electronic control unit (not shown) for controlling the operation of the engine.

Figure 4:
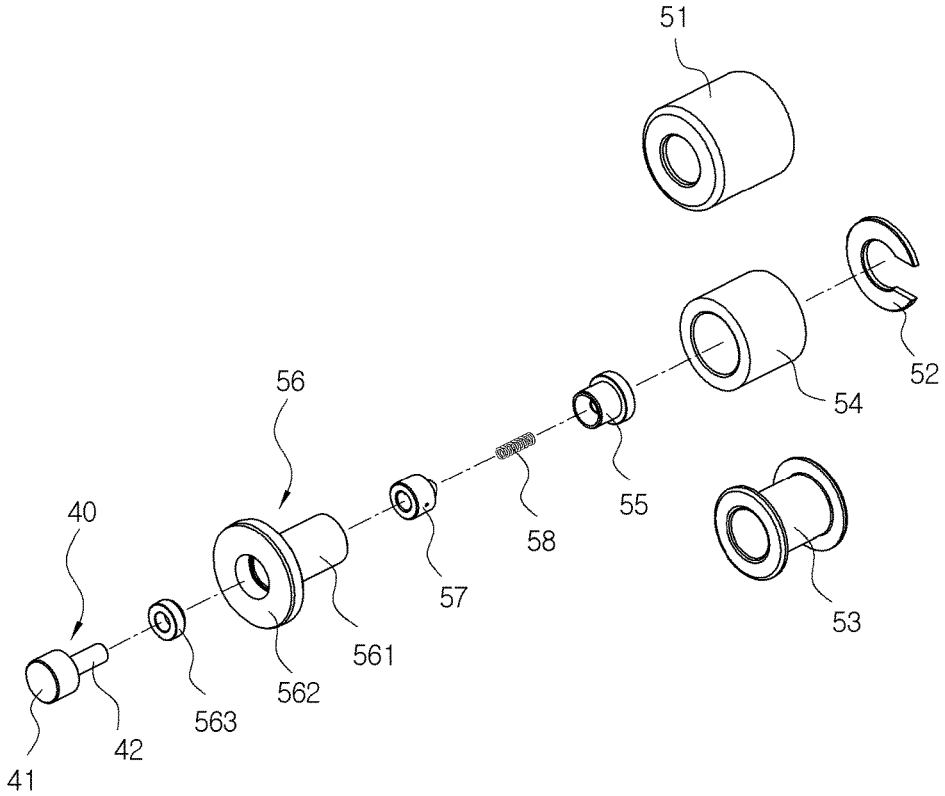
FIG. 4 is an exploded perspective view of a driving module and a driving pin.

For example, FIG. 4 is an exploded perspective view of a driving module and a driving pin.

As shown in FIGS. 2 to 4, the driving module 50 may be prepared with a solenoid including a casing 51 formed in a substantially cylindrical shape having a space therein and having a rear surface opened, a coupling member 52 coupled to the rear surface of the casing 51, a bobbin 53 installed inside the casing, having a coil 54 wound around an outer peripheral surface of the bobbin, and having a core 55 installed in the bobbin, a sleeve 56 coupled to a front end of the casing 51 in which the driving pin 40 is installed in the sleeve to move back and forth, and a plunger 57 installed to move back and forth inside the sleeve 56.

An entire portion or a partial front end of the driving module 50 may be inserted into the rear end of the second body 30.

To this end, the second body 30 may be formed at the rear end thereof with an insertion space 301 into which the driving module 50 is inserted.

According to the present invention, the driving module is installed while being inserted into the rear end of the second body so as to minimize a mounting space when mounted on the cylinder head, so that the structural constraint of the cylinder head can be minimized.

The plunger 57 moves back and forth according to a magnetic field generated in the coil 54 so as to enable the driving pin 40 coupled to the front end to move back and forth.

A spring 58 for providing restoring force may be installed between the plunger 57 and the core 54 to forwardly move the driving pin 40 when the magnetic field is removed.

To this end, the core 54 may be coupled to the rear end of the bobbin 53 and the coupling member 52, and a first support groove for supporting the rear end of the spring 58 after the insertion may be formed on the front surface of the core 55.

In addition, a second support groove for supporting the front end of the spring 58 after the insertion thereof may be formed on the rear surface of the plunger 57, and a coupling groove to which a coupling part 42 of the driving pin 40 is coupled may be formed on the front face of the plunger 57.

The sleeve 56 may include a cylindrical part 561 formed in a substantially cylindrical shape and a flange part 562 provided at a front end of the cylindrical part 561 so as to form a space where the plunger 57 moves therein.

The flange part 562 is installed such that the rear surface thereof makes contact with a front surface of the casing 51, and a stopper 563 may be installed on an inner front end of the cylindrical part 561 to prevent the plunger 57 from being forwardly separated and guide a movement of the driving pin 40 in forward and backward directions.

In the driving module 50 having the above configuration, when power is supplied according to the control signal, the coil 54 wound inside the driving module generates a magnetic field to move the driving pin 40 backward.

Accordingly, as the driving pin 40 moves backward, the first body 20 may be disconnected with the second body 30.

In addition, when the power is cut off according to the control signal, the magnetic field generated inside the driving module 50 is removed, thus the driving pin 40 may be moved forward by the restoring force of the spring 58, thereby returning to the original position. Accordingly, as the driving pin 40 moves forward, the first body 20 may be connected with the second body 30.

In other words, according to the present invention, the conventional latching pin and latching spring are removed, and the driving pin of the driving module protrudes and retracts, so that the first body and the second body are connected or disconnected with each other.

Accordingly, the present invention can improve the operating performance by connecting or disconnecting the first and second bodies with each other using the driving pin, compared with the case where the conventional latching pin is applied.

In addition, according to the present invention, the driving module is installed while being inserted into the rear end of the second body so as to minimize a mounting space when mounted on the cylinder head, so that the structural constraint of the cylinder head can be minimized.

Meanwhile, it should be noted that although the driving module is described as a solenoid in the present embodiment, the present invention is not limited thereto, and the present invention may be modified to adopt various types of operating units, such as a motor in addition to the solenoid, driven by supplying the power.

Next, a method of operating the variable valve lift actuator of the engine according to a first embodiment of the present invention will be described in detail with reference to FIGS. 5 and 6.

Figure 5:
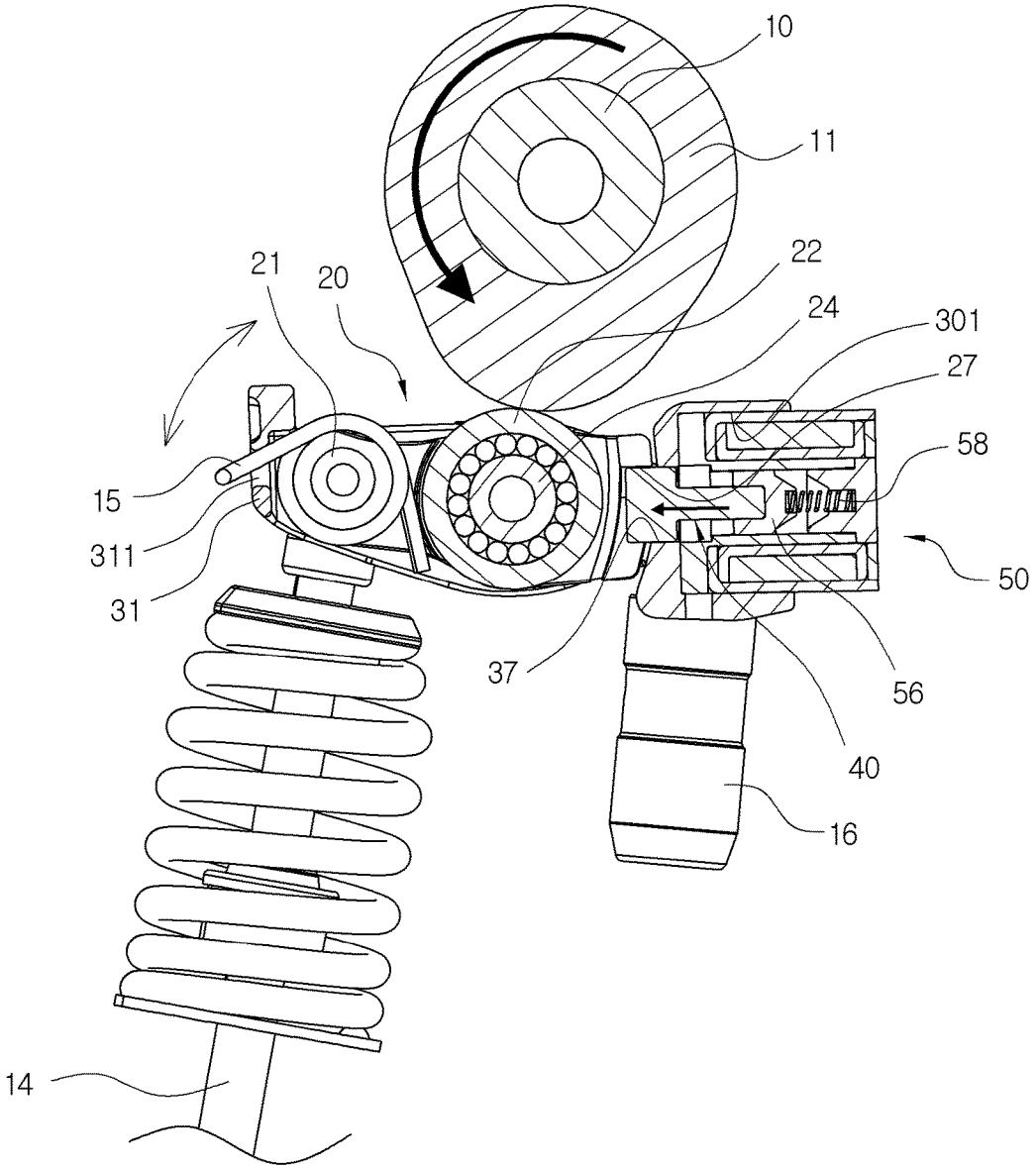
FIGS. 5 and 6 are operational state views showing an operational state of a variable valve lift actuator of an engine according to a first embodiment of the present invention.
Figure 6:
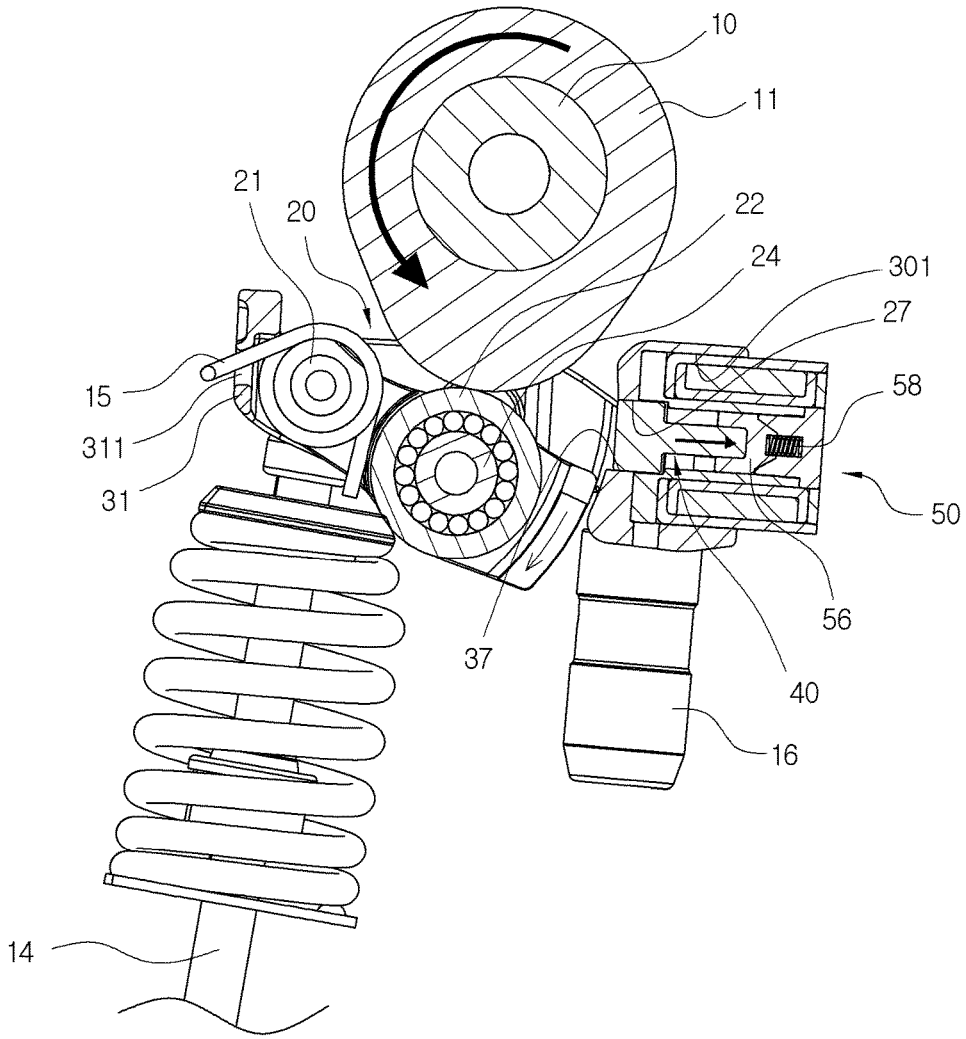

FIGS. 5 and 6 are operational state views showing an operational state of a variable valve lift actuator of an engine according to a first embodiment of the present invention.

FIG. 5 shows an operation state in which the valve is opened and closed according to the rotational motion of the cam in the variable valve lift actuator of the engine. FIG. 6 shows an operation state of controlling the pause of the valve.

The variable valve lift actuator of the engine according to a first embodiment of the present invention, as shown in FIG. 5, moves the driving pin 40 forward when the valve 14 is opened and closed according to the rotational motion of the cam 11.

Then, the front end of the driving pin 40 passes through the installation part 36 of the second body 30, protrudes forward, and is latched to the latching sill 27 formed on the rear wall of the first body 20, thereby connecting the first body 20 with the second body 30.

Based on the variable valve lift actuator of the engine according to a first embodiment of the present invention, the first and second bodies 20 and 30 may move the valve 14 up and down while rotating according to the rotational motion of the cam 11 in a predetermined angular range, thereby opening and closing the valve 14.

At this point, the center portion of the return spring 15 installed around the rotary shaft 21 is supported so as not to move up and down while being inserted into the insertion hole 311 formed in the front wall 31 of the second body 30, in which both ends of the return spring 15 are supported by the supporting sills 26 formed on both side walls of the first body 20.

Thus, the return spring 15 may provide the restoring force to the first body 20, so that the first and second bodies 20 and 30 rotated according to the cam 11 are returned to the original positions.

Whereas, in the case of implementing the pause control operation of the valve 14 to deactivate some cylinders in the variable valve lift actuator of the engine according to a first embodiment of the present invention, power is applied to the driving module 50 according to the control signal of the electronic control unit.

Then, as shown in FIG. 6, the driving pin 40 moves backward by the magnetic field generated in the driving module 50 while elastically deforming the spring 58 of the driving module 50.

Accordingly, the driving pin 40 is accommodated in the installation part 36 of the second body 30 while moving backward, thus the first body 20 is separated from the second body 30.

Then, the front end and the rear end of the second body 30 are fixed in contact with the upper end of the valve 14 and the upper end of the pivot support mechanism 16, respectively.

Therefore, based on the variable valve lift actuator of the engine according to a first embodiment of the present invention, because the second body 30 making contact with the upper end of the valve 14 is in a fixed state even if the cam 11 rotates, the pause control operation of the valve 14 can be implemented.

According to the present invention, the opening/closing operation and the pause control operation of the valve are implemented by selectively connecting or disconnecting the first body with the second body by using the driving pin of the driving module, so that some cylinders can be deactivated in the low-speed and low-load condition of the engine.

According to the present invention, the fuel consumption amount is minimized in the low-speed and low-load state of the engine, so that the efficiency of the engine can be improved and the fuel efficiency of the vehicle can be maximized.

In addition, according to the present invention, the conventional latching pin and latching spring are removed, and the first and second bodies are connected or disconnected with each other by using the driving pin of the driving module, so that dynamic characteristics and operating performance of the valve can be improved, and the number of parts is reduced, so that manufacturing costs can be reduced.

In addition, according to the present invention, the driving module is installed while being inserted into the rear end of the second body so as to minimize a mounting space when mounted on the cylinder head, so that the structural constraint of the cylinder head can be minimized.

Meanwhile, although the first embodiment is described with reference to the pause control operation of the valve, the present invention is not limited thereto.

In other words, according to the present invention, the two-stage control operation can be implemented together with the pause control operation of the valve depending on the configuration of the cam by only changing the configuration of the cam and using a variable valve lift actuator of an engine having the same configuration

Embodiment 2

Next, the configuration of the variable valve lift actuator of the engine according to the second embodiment will be described in detail with reference to drawings.

Figure 7:
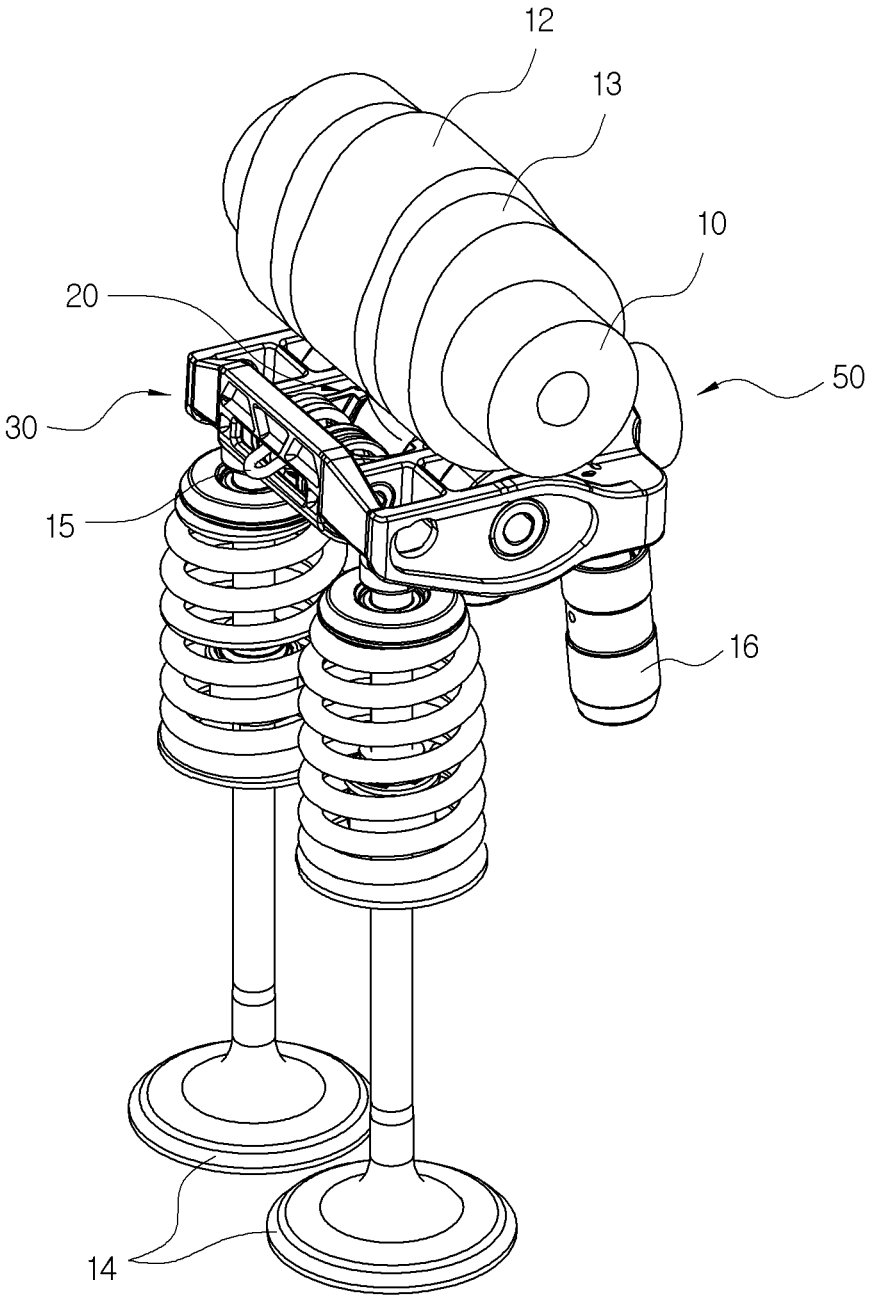
FIG. 7 is a perspective view of a variable valve lift actuator of an engine according to a second embodiment of the present invention.

FIG. 7 is a perspective view of a variable valve lift actuator of an engine according to the second embodiment of the present invention.

As shown in FIG. 7, the variable valve lift actuator of the engine according to the second embodiment of the present invention is similar to the configuration of the first embodiment. However, some configurations may be added to control the lift degree of the valve in two stages of the high-speed mode or the low-speed mode based on an operating condition of the engine.

In other words, the camshaft 10 may be provided therein with a high-speed cam 12 for controlling the lift degree of the valve 14 to be maximum in a high-speed and high-load state of the engine, and a low-speed cam 13 for controlling the lift degree of the valve 14 to be minimum in a low-speed and low-load state of the engine.

The high-speed cam 12 may be manufactured in a shape corresponding to the cam 11 of the first embodiment.

The low-speed cam 13 may be provided in pairs to make contact with the both ends of the second body 30, and installed on the both sides of the high-speed cam, respectively.

The above low-speed cam 13 is manufactured to have a maximum diameter smaller than the maximum diameter of the high-speed cam 12.

Herein, the roller 22 coupled to the roller shaft 24 is installed to make contact with the high-speed cam 12, and the first and second rollers 38 and 39 are installed to make contact with the pair of low-speed cams 13, respectively.

Next, a method of operating the variable valve lift actuator of the engine according to the second embodiment of the present invention will be described in detail with reference to FIGS. 8 and 9.

Figure 8:
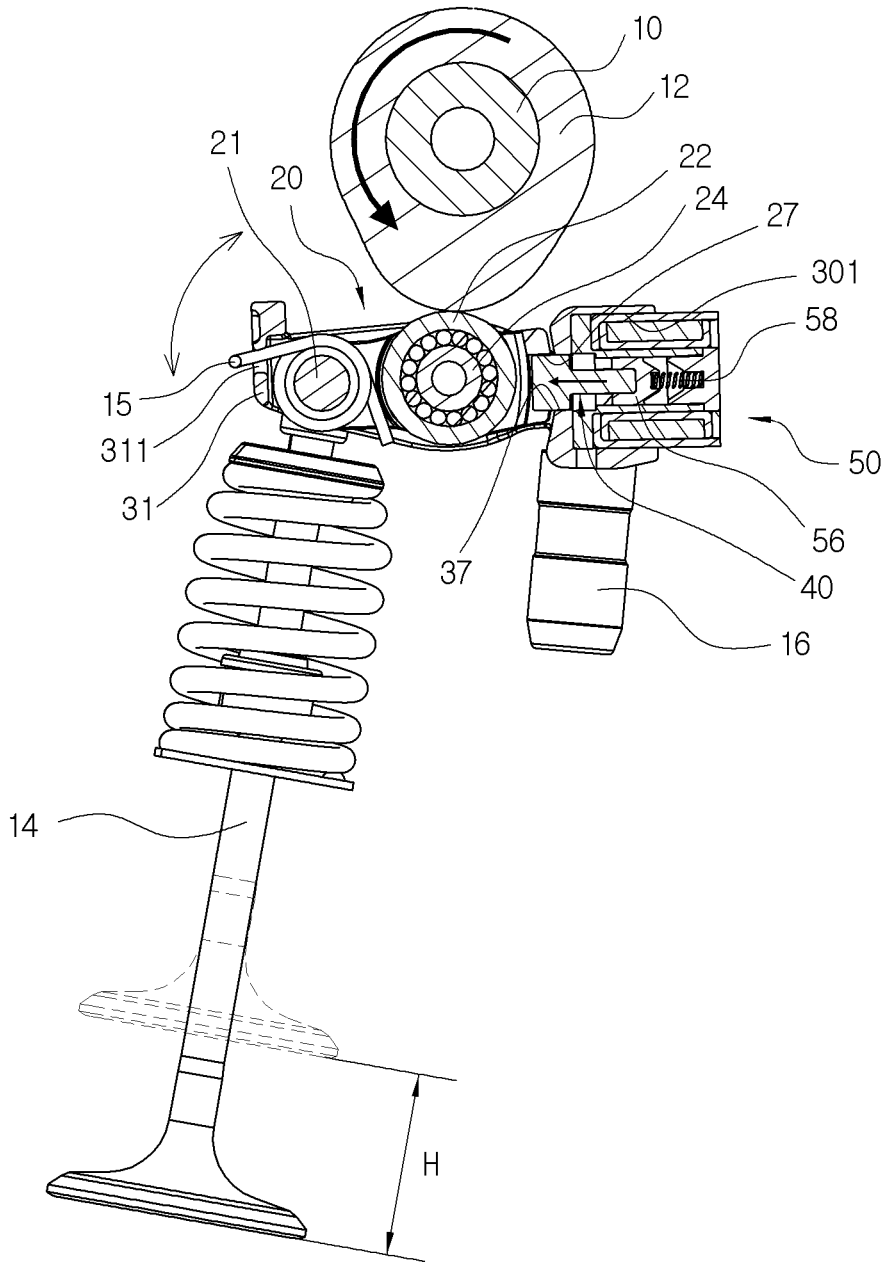
FIGS. 8 and 9 are operational state views showing an operational state of a variable valve lift actuator of an engine according to a second embodiment of the present invention.
Figure 9:
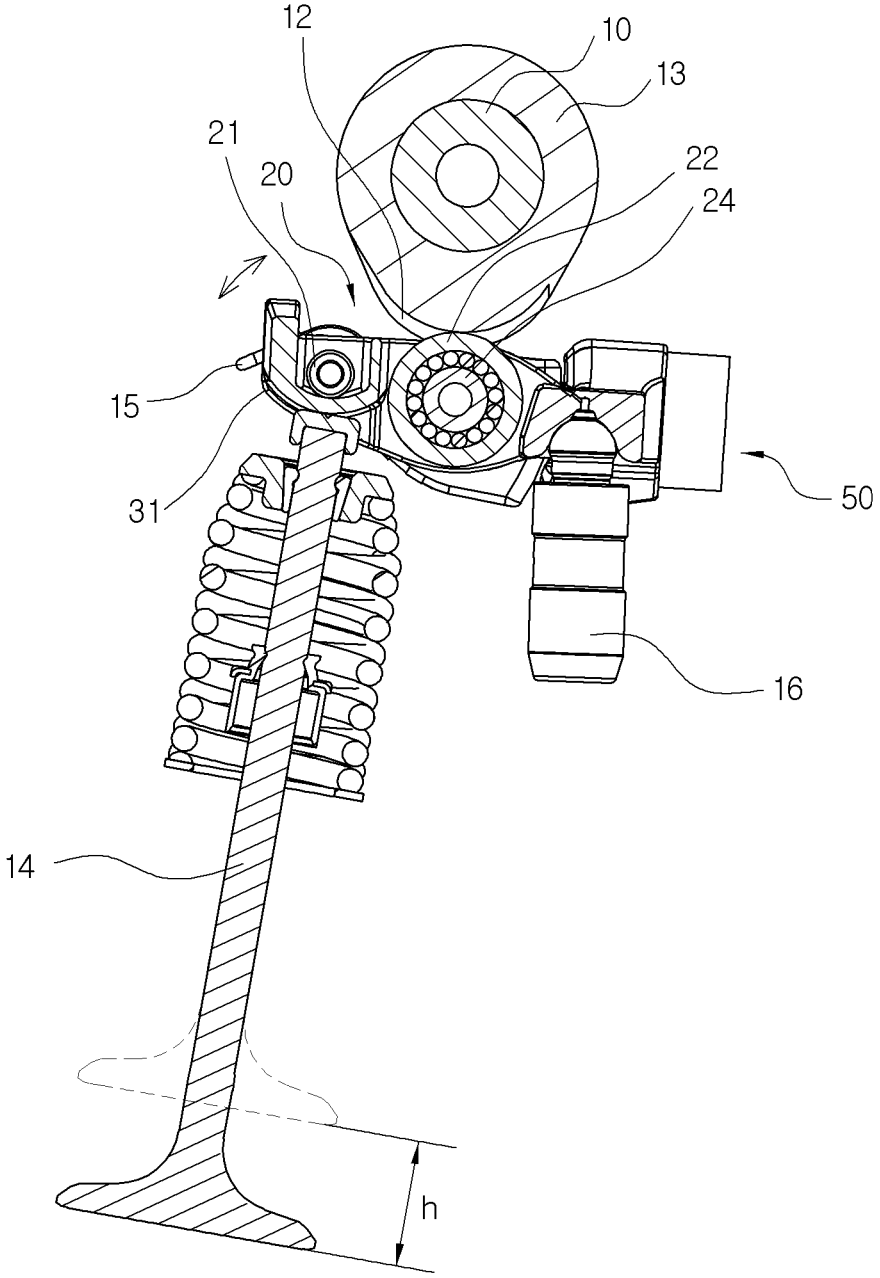

FIGS. 8 and 9 are operational state views showing an operational state of a variable valve lift actuator of an engine according to the second embodiment of the present invention.

FIG. 8 shows an operational state of the variable valve lift actuator of the engine operating in the high-speed mode in the high-speed and high-load state of the engine.

FIG. 9 shows an operational state of the variable valve lift actuator of the engine operating in the low-speed mode in the low-speed and low-load state of the engine.

Based on the variable valve lift actuator of the engine according to the second embodiment of the present invention, as shown in FIG. 8, the power applied to the driving module 50 is cut off by using the control signal of the electronic control unit in the high-speed and high-load state of the engine, and the plunger 57 and the driving pin 40 are moved forward by using the restoring force of the spring 58.

Then, the front end of the driving pin 40 passes through the installation part 36 of the second body 30, protrudes forward, and is latched to the latching sill 27 formed on the rear wall of the first body 20, thereby connecting the first body 20 with the second body 30.

At this point, the first body 20 makes contact with the high-speed cam 12 provided on the camshaft 10, thereby rotating together with the second body 30.

Based on the variable valve lift actuator of the engine according to the second embodiment of the present invention, the first and second bodies 20 and 30 may move the valve 14 up and down while rotating according to the rotational motion of the high-speed cam 12 in a predetermined angular range, thereby opening and closing the valve 14.

At this point, a lift degree H of the valve 14 according to the high-speed cam 12 is larger than a lift degree h (see FIG. 9) of the valve 14 according to the low-speed cam 13, thus the flow rate of the air supplied to the cylinder of the engine increases.

Whereas, based on the variable valve lift actuator of the engine according to the second embodiment of the present invention, as shown in FIG. 9, the driving module 50 is driven in accordance with the control signal of the electronic control unit to move the driving pin 40 rearward in the low-speed and low-load state of the engine.

Accordingly, the driving pin 40 retains a state of being accommodated inside the installation part 36 of the second body 30, thereby separating the first body 20 from the second body 30.

At this point, the first and second rollers 38 and 39 installed at the second body 30 make contact with the pair of low-speed cams 13 installed at the camshaft 10 and rotate.

Then, the second body 30 rotates about the pivot support mechanism 16 according to the rotational motion of the low-speed cam 13, thereby opening and closing the valve 14.

At this point, the lift degree h of the valve 14 according to the low-speed cam 13 is smaller than the lift degree H (see FIG. 8) of the valve 14 according to the high-speed cam 12, thus the flow rate of the air supplied to the cylinder of the engine is reduced.

According to the present invention, the first body and the second body are connected or disconnected with each other using the driving pin of the driving module, so that the lift degree of the valve can be controlled in two stages of the high-speed mode and the low-speed mode according to the rotational motion of the high-speed cam or the low-speed cam.

As above-mentioned, the present invention, the two-stage control operation and the pause control operation of the valve can be implemented according to the configuration of the cam by only changing the configuration of the cam and using the variable valve lift actuator having the same configuration.

Meanwhile, in the above embodiments, the semi-cylindrical pressing pieces are formed on both sides of the second body so that the pressing pieces make contact with the upper end of the valve, thereby increasing the contact area, so that the operational properties of the valve can be improved.

However, the present invention is not limited thereto.

Embodiment 3

Figure 10:
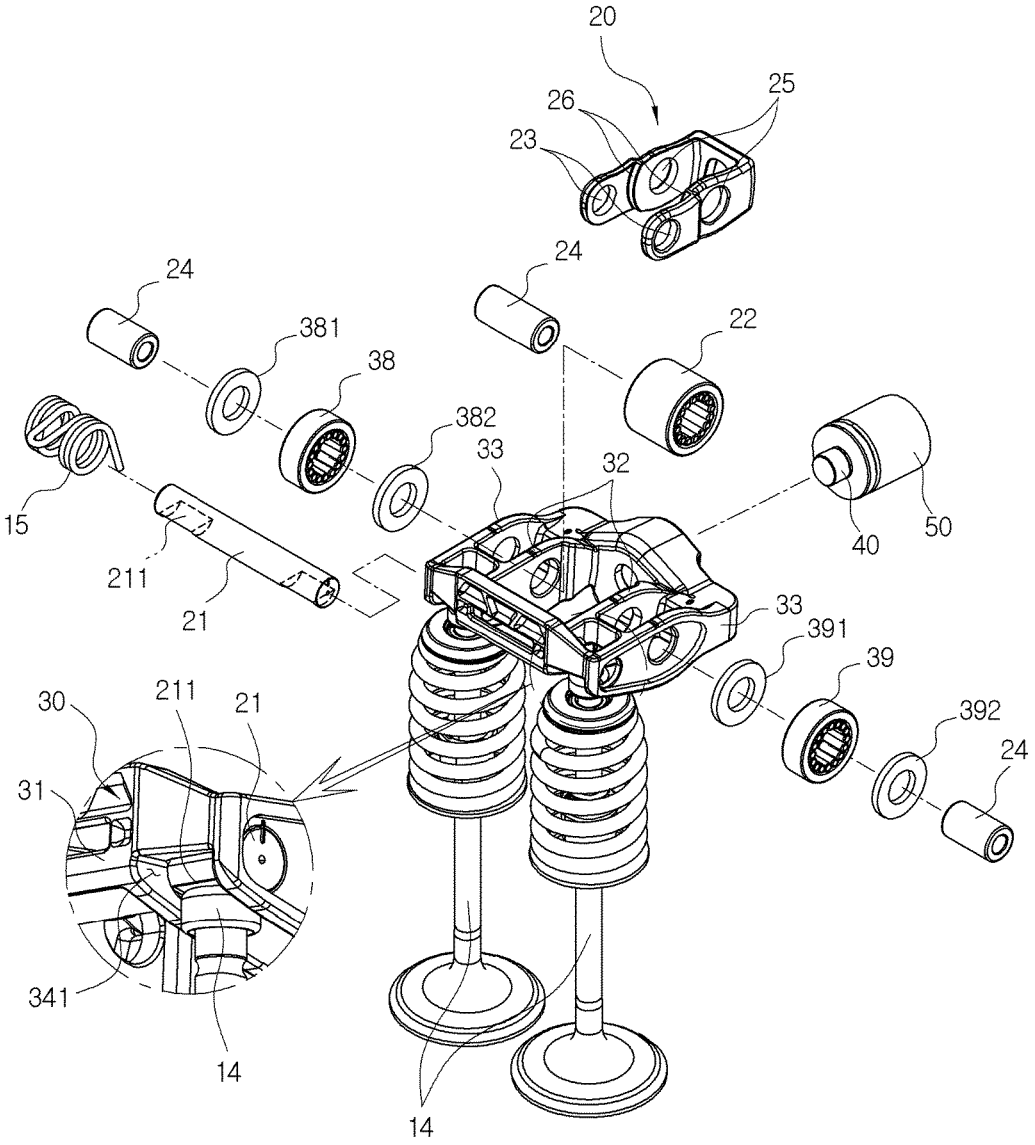
FIG. 10 is an exploded perspective view of the variable valve lift actuator of an engine according to a third embodiment of the present invention.

FIG. 10 is a perspective view of a variable valve lift actuator of an engine according to a third embodiment of the present invention.

According to a third embodiment of the present invention, as shown in FIG. 10, the variable valve lift actuator of the engine is similar to the configurations of the first and second embodiments. However, an opening 341 may be formed on both sides of the front wall 31 of the second body, such that the lower end of the rotary shaft 21 makes contact with the upper end of the valve 21 between the inner side wall 32 and the outer side wall 33.

Accordingly, the rotary shaft 21 downwardly presses the upper end of the valve 14 according to the rotational motion of the second body 30, thereby enabling the valve 14 to be opened and closed.

To this end, the rotary shafts 21 may extend to be coupled to the outer side walls 33 on both sides of the second body 30.

In addition, contact surfaces 211 processed in a planar shape may be formed at lower surfaces of both ends of the rotary shaft 21 to increase the contact area on the upper end of the valve 14.

In other words, when the valve 14 is pressed using the cylindrical rotary shaft 21, the rotary shaft 21 makes line-contact with the upper end of the valve 14, thereby reducing the contact area, thus the operational characteristics of the valve 14 may be deteriorated.

According to the present invention, the contact surfaces are formed on the lower surface of both ends of the cylindrical rotary shaft, thus the rotary shaft makes surface-contact with the upper end of the valve, thereby increasing the contact area, so that the operating characteristics of the valve may be improved.

The present invention implemented by the inventor is described in detail according to the above embodiments, however, the present invention is not limited to the embodiments and various modifications are available within the scope without departing from the invention.

INDUSTRIAL APPLICABILITY

The present invention can be applied to the technology regarding an engine variable valve lift actuator for performing a pause control operation of the valve to deactivate some cylinders and the two-stage variable control operation of a high-speed mode and a low-speed mode according to an operating condition of the engine.

REFERENCE NUMERALS

| | | |
|---|---|---|
| 10: camshaft | 11: cam | |
| 12: high-speed cam | 13: low-speed cam | |
| 14: valve | 15: return spring | |
| 16: pivot support mechanism | | |
| 20: first body | 21: rotary shaft | |
| 211: contact surface | 22: roller | |
| 23: coupling hole | 24: roller shaft | |
| 25: installation hole | 26: supporting sill | |
| 27: latching sill | 30: second body | |
| 301: insertion space | 31: front wall | |
| 311: insertion hole | 32: inner side wall | |
| 33: outer side wall | 34: pressing piece | |
| 341: opening part | 35: support plate | |
| 36: installation part | 37: moving space | |
| 38, 39: first, second roller | | |
| 41: body part | 381, 382, 391, 392: roller bush | 40: driving pin |
| 42: coupling part | | |
| 50: driving module | 51: casing | |
| 52: coupling member | 53: bobbin | |
| 54: coil | 55: core | |
| 56: sleeve | 561: cylindrical part | |
| 562: flange part | 563: stopper | |
| 57: plunger | 58: spring | |
| 60: cylinder head | | |

What is claimed is:

1. A variable valve lift actuator of an engine, the variable valve lift actuator comprising:

a first body rotating in a predetermined angular range according to a rotational motion of a high-speed cam coupled to a camshaft;

a second body connected to or disconnected from the first body, rotated according to the rotational motion of the high-speed cam when connected with the first body, and rotated according to a rotational motion of low-speed cams disposed on both sides of the high-speed cam when disconnected with the first body, thereby adjusting a lift degree of a valve;

a driving module for operating a driving pin such that the driving pin protrudes toward or retracts from a front of the first body so as to connect or disconnect the first body to or from the second body;

a rotary shaft disposed on an upper portion of the valve while crossing both side walls of the first and second bodies to enable the rotational motion of the first body; and a return spring disposed around the rotary shaft to provide restoring force so as to return the first body rotated by the high-speed cam to an original position, wherein the lift degree of the valve is variably controlled in two stages of a high-speed mode and a low-speed mode based on an operating condition of the engine, when only the high-speed cam is disposed on the camshaft, a pause control operation is performed in which the driving pin is operated in a low-speed and low-load state of the engine to separate the first body from the second body so as to deactivate a cylinder, and an entire portion or a partial front end of the driving module is inserted into a rear end of the second body, wherein the driving module comprises:

a casing formed in a substantially cylindrical shape having a space therein and having a rear surface opened;

a coupling member coupled to the rear surface of the casing;

a bobbin disposed inside the casing, having a coil wound around an outer peripheral surface of the bobbin, and having a core disposed in the bobbin;

a sleeve coupled to a front end of the casing in which the driving pin is disposed in the sleeve to move back and forth; and a plunger disposed in the sleeve to move back and forth inside the sleeve and coupled with the driving pin, and wherein a spring for providing restoring force is disposed between the plunger and the core to forwardly move the driving pin when a magnetic field generated from the coil is removed, and the rear end of the second body has an insertion space into which the driving module is inserted.

2. The variable valve lift actuator of claim 1, wherein the second body comprises a front wall, an inner side wall, and an outer side wall disposed on a front surface and both sides of the first body, respectively, and a support plate disposed between the inner side wall and the outer side wall and supported by making contact with an upper end of a pivot support mechanism, and wherein a center portion of the return spring protrudes to be supported after being inserted into an insertion hole formed in the front wall of the second body, both ends of the return spring are supported by a supporting sill formed on the both side walls of the first body, a pressing piece for pressing an upper end of the valve is formed between the inner side wall and the outer side wall, and the pressing piece is formed in a semi-cylindrical shape having a cross section which is downwardly convex.

3. The variable valve lift actuator of claim 1, wherein the second body comprises a front wall, an inner side wall, and an outer side wall disposed on a front surface and both sides of the first body, respectively, and a support plate disposed between the inner side wall and the outer side wall and supported by making contact with an upper end of a pivot support mechanism, and wherein a center portion of the return spring protrudes to be supported after being inserted into an insertion hole formed in the front wall of the second body, both ends of the return spring are supported by a supporting sill formed on the both side walls of the first body, an opening is formed between the inner side wall and the outer side wall so that lower surfaces of both ends of the rotary shaft make contact with the upper end of the valve, and the lower surfaces of the both ends of the rotary shaft are formed thereon with a contact surface to make surface-contact with the upper end of the valve.

4. The variable valve lift actuator of claim 1, wherein first and second rollers rotated by the low-speed cam are disposed between the inner side wall and the outer side wall of the second body to reduce friction when contacting with the low-speed cam, a roller rotated by the high-speed cam is disposed in the first body to reduce friction when contacting with the high-speed cam, the first body has a latching sill latched to the driving pin at a rear end of the first body so as to integrally rotate the first and second bodies according to the rotational motion of the high-speed cam when the driving pin forwardly moves, an installation part is disposed in the second body and the driving pin is disposed in the installation part to slidably move therethrough, and the installation part has a moving space serving as a movement path for the driving pin.

5. The variable valve lift actuator of claim 2, wherein first and second rollers rotated by the low-speed cam are disposed between the inner side wall and the outer side wall of the second body to reduce friction when contacting with the low-speed cam, a roller rotated by the high-speed cam is disposed in the first body to reduce friction when contacting with the high-speed cam, the first body has a latching sill latched to the driving pin at a rear end of the first body so as to integrally rotate the first and second bodies according to the rotational motion of the high-speed cam when the driving pin forwardly moves, an installation part is disposed in the second body and the driving pin is disposed in the installation part to slidably move therethrough, and the installation part has a moving space serving as a movement path for the driving pin.

6. The variable valve lift actuator of claim 3, wherein first and second rollers rotated by the low-speed cam are disposed between the inner side wall and the outer side wall of the second body to reduce friction when contacting with the low-speed cam, a roller rotated by the high-speed cam is disposed in the first body to reduce friction when contacting with the high-speed cam, the first body has a latching sill latched to the driving pin at a rear end of the first body so as to integrally rotate the first and second bodies according to the rotational motion of the high-speed cam when the driving pin forwardly moves, an installation part is disposed in the second body and the driving pin is disposed in the installation part to slidably move therethrough, and the installation part has a moving space serving as a movement path for the driving pin.

* * * * *